United States Patent [19]

Pugatch

[11] Patent Number: 5,009,343

[45] Date of Patent: Apr. 23, 1991

[54] AUTOMOTIVE TOOL

[76] Inventor: Benjamin E. Pugatch, 68 Pond St., North Easton, Mass. 02356

[21] Appl. No.: 478,936

[22] Filed: Feb. 12, 1990

[51] Int. Cl.[5] ..... B67D 1/07

[52] U.S. Cl. ..... 222/192; 222/210; 222/527; 401/139; 401/187; 401/266

[58] Field of Search ..... 222/191, 192, 210, 215, 222/465.1, 527, 575; 401/139, 266, 11, 140, 187

[56] References Cited

U.S. PATENT DOCUMENTS

| | | | |
|---|---|---|---|
| 1,208,865 | 12/1916 | Warwick | 401/11 |
| 1,372,228 | 3/1921 | Humphreys | 222/210 |
| 3,016,040 | 1/1962 | Crookston, Jr. | 401/266 X |
| 3,134,515 | 5/1964 | Callahan | 222/527 X |
| 3,402,741 | 9/1968 | Yurdin | 222/527 X |
| 3,536,411 | 10/1970 | Eisert | 401/266 X |
| 4,947,580 | 8/1990 | Moore | 401/11 X |

FOREIGN PATENT DOCUMENTS

| | | | |
|---|---|---|---|
| 335432 | 11/1903 | France | 401/11 |

*Primary Examiner*—Michael S. Huppert
*Assistant Examiner*—Gregory L. Huson

[57] ABSTRACT

This is an automotive tool which has a head, a container and a flexible hose connection with the container. The container has a nozzle and a pump. The hose connects the nozzle of the container to the head. The head has a blade which extends longitudinally and is arced so that it may be positioned within the nipple of a plug wire terminal of an automobile spark plug so that it is between the inner wall of the nipple and the top cap of the spark plug. If the connection between the plug wire terminal and the top cap has in effect become fused the pump can force a solvent from the container through the hose onto the blade portion and against the fused area. The fused area can now be broken permitting removal of the spark plug without damage to the plug wire terminal.

1 Claim, 1 Drawing Sheet

AUTOMOTIVE TOOL

BACKGROUND OF THE INVENTION

Field of the Invention

This invention relates to tools and more specifically to tools utilized in working with motor vehicles.

SUMMARY OF THE INVENTION

The invention disclosed herein is directed at a tool having a head portion, a container and a flexible hose connection. The container has a nozzle and a pump means and the flexible hose connection connects the nozzle to the head portion. The head portion has a longitudinally extended, arced blade portion whereby action of the pump means forces fluid in the container through the flexible hose connection onto the blade portion.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
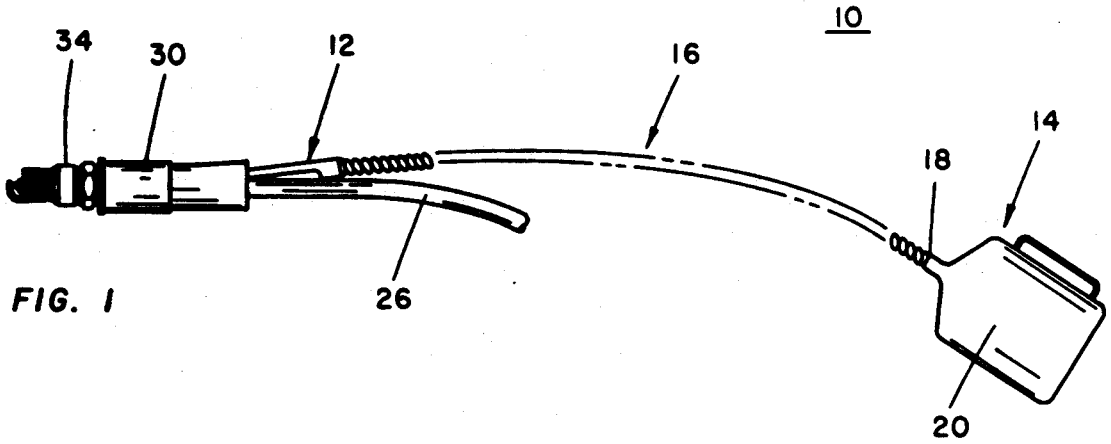
FIG. 1 is a side elevational view of the automotive tool according to the present invention.
Figure 2:
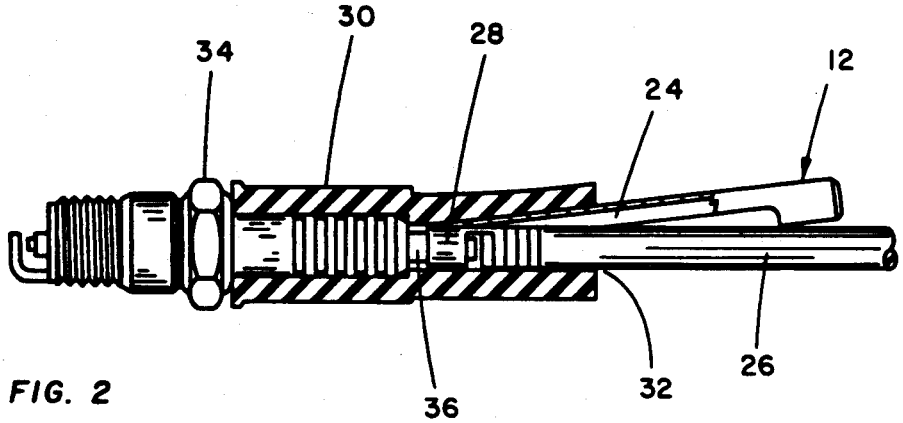
FIG. 2 is a sectional view of the automotive tool shown in FIG. 1 broken off.
Figure 3:
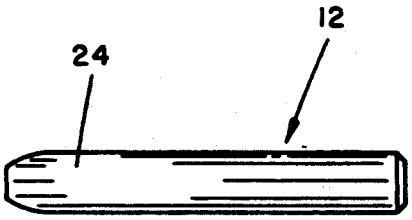
FIG. 3 is a top plan of the head portion of the automotive tool according to the present invention.
Figure 4:
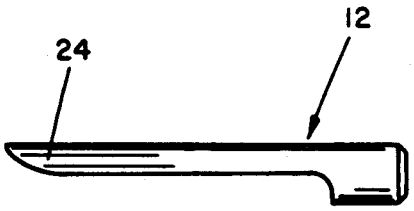
FIG. 4 is a side elevational view of the head portion of the automotive tool shown in FIG. 3.
Figure 5:
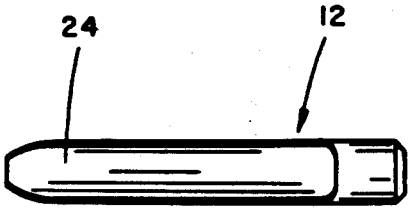
FIG. 5 is a bottom plan view of the head portion of the automotive tool shown in FIG. 3.
Figure 6:
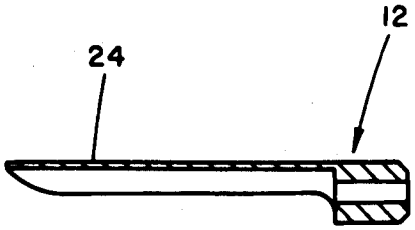
FIG. 6 is a side elevational view of the head portion of the automotive tool shown in FIG. 3.

There is shown in the drawings a tool 10. The tool 10 having a head portion 12 and a container 14 connected by a flexible hose connection 16. The container 14 has a nozzle 18, a reservoir - pump means 20. The flexible hose connection 16 connects the nozzle 18 to the head portion 12. The head portion 12 has a longitudinally extended, arced, comparatively thin blade portion 24. A spark plug wire 26 has its plug wire terminal 28 positioned within a nipple 30. The nipple 30 has a rear aperture or opening 32 through which the spark plug wire 26 is passed. The top cap 36 of the spark plug 34 is positioned within the nipple 30 and electrically engages the plug wire terminal 28.

Where operating spark plugs have not been changed for a long time, the plug wire terminal 28 in effect fuses to the top cap 36 within the nipple 30. An attempt to break the connection between the plug wire terminal 28 and the top cap 36 could result in the destruction of the spark plug 34 and the spark plug wire 26. A method of avoiding a destructive separation is to apply a solvent such as a carburetor cleaner to the fused plug wire terminal 28 and the top cap 36 of the spark plug 34. Assuming that the operator has discovered that the connection between the plug wire terminal 28 and the top cap 36 will not break after normal force is applied, the head portion 12 of the tool 10 is slipped between the inner wall of the nipple 30 and the top cap 36. The reservoir - pump 20 of the container 14 is filled with an appropriate solvent, such as a carburetor cleaner, and is pumped through the flexible hose connection 16 to the blade portion 24 of the head portion 12. Positioning the blade portion within the nipple 30, allows the action of the pump 18 to force the solvent in the reservoir - pump 20 through the flexible hose connection 16 onto the blade portion 24 along the spark plug wire and onto the connection between the plug wire terminal 28 and the top cap 36. In most cases the solvent will loosen the connection between the top cap 36 and the plug wire terminal 28 so that a comparatively small amount of force will allow separation of the nipple 30 and the spark plug 36 without damage to any part.

What I claim is:

1. The combination of a tool, a spark plug wire and a spark plug, the tool comprising a head portion, a container and a flexible hose connection, the container having a nozzle and a pump to pump fluid contents therefrom, the flexible hose connection connecting the nozzle to the head portion, the head portion having a longitudinally extended, arced blade portion, the spark plug wire having a plug wire terminal positioned within a nipple, the nipple having a rear aperture, the spark plug wire passed through the rear aperture, the spark plug including a top cap, the top cap positioned within the nipple and electrically engaging the plug wire terminal whereby after positioning the blade portion at the rear aperture and within the nipple, action of the pump forces said fluid in the container through flexible hose connection onto the blade portion and onto the connection between the plug wire terminal and the top cap.

* * * * *